United States Patent [19]

Witek, Jr.

[11] 4,227,760

[45] Oct. 14, 1980

[54] LAMP SOCKET STRUCTURE

[75] Inventor: Roman J. Witek, Jr., Gibraltar, Mich.

[73] Assignee: International Telephone and Telegraph Corporation

[21] Appl. No.: 38,063

[22] Filed: May 11, 1979

[51] Int. Cl.[3] ..... H01R 4/66

[52] U.S. Cl. ..... 339/14 R; 339/17 D; 339/126 R

[58] Field of Search ..... 339/14, 17 D, 88 R, 339/94 L, 126 R, 127 R, 147 R, 217 S, 262 R

[56] References Cited

U.S. PATENT DOCUMENTS

| | | | |
|---|---|---|---|
| 2,892,992 | 6/1959 | Grovemiller et al. | 339/17 D |
| 3,206,708 | 9/1965 | Gerald | 339/17 D X |
| 3,718,892 | 2/1973 | Burgess et al. | 339/126 R |
| 3,909,096 | 9/1975 | Brzozowski | 339/17 D |
| 4,076,358 | 2/1978 | Taormina et al. | 339/17 D |

*Primary Examiner*—Roy Lake

*Assistant Examiner*—DeWalden W. Jones

*Attorney, Agent, or Firm*—James B. Raden; Marvin M. Chaban

[57] ABSTRACT

A lamp socket adapted to receive a bayonet base lamp bulb for illumination uses on an automotive vehicle. The socket is essentially cup-shaped and of one-piece plastic construction. The bulb contacting terminal members and grounding ring are all adapted to be inserted from the bulb end of the socket. The terminal members snap into designated slots in the bulb receiving wall of the socket. The grounding ring is a unitary, formed member with terminals at both opposed ends. The grounding ring forms the wall into which the bulb base is inserted. With the terminal members and grounding ring in place, terminals are provided for the engagement with conductors of a printed circuit board. The terminals have spring contactors spaced in an annulus insulated and spaced from the bulb. The bulb imposes a locking pressure on the bulb terminals by pushing the terminals further into the assembly.

8 Claims, 14 Drawing Figures

LAMP SOCKET STRUCTURE

BACKGROUND OF THE INVENTION:

Lamp sockets for use in automotive vehicles are, of course, well-known in the art. The more recent sockets have a molded plastic body, some one-piece, some two-piece. Various configurations of contact terminals have been designed to provide a grounding terminal and bulb engaging contacts. They are generally designed for ready assembly of the contacts into the plastic body.

A patent which shows an exemplary socket with a plastic bulb receiving insert is U.S. Pat No. 3,909,096 to Brzozowski issued Sept. 30, 1975. In this patent, the socket insert acts to latch the contacts in place responsive to the installation of the locking insert. The contacts when installed have terminals extending in a ring within the outer socket annulus to enable connection of power and grounding leads to the socket.

An example of a one-piece socket may be found in U.S. Pat. No. 3,718,892 issued Feb. 27, 1973 to J. Burgess et al. This patent shows a one-piece plastic socket body with a two-piece main bulb contact. The contacts are inserted from the terminal end through slots in the base beneath the bulb area for engagement with a bulb base.

In both of these patents, the contacts are inserted through the bottom of the socket to extend into the bulb cavity. Using these approaches, the bulb may tend to loosen the mounting of the terminals within the socket since the direction of bulb pressure is toward ejection of the terminals from the bulb assembly.

SUMMARY OF THE INVENTION

The present invention is directed to an improved lamp socket adapted for use as a parking light for a tail light or for directional signal lights of automotive vehicles. The lamp socket is fabricated by molding or the like into a one-piece, cup-shaped plastic body. The body has a cavity for a bulb of the bayonet type, the cavity having a generally tubular wall defining the cavity. Externally of the wall, there is a flanged annular recess for retaining therein the contact terminals. The bulb engaging contacts are essentially L-shaped, are inserted from the bulb end of the socket through sized openings in the opposite sides of tubular wall to engage the lamp base. To provide both an electrical grounding contact and a mechanical receiver for the bulb bayonet prongs, a tubular metal grounding ring mounts in the tubular cavity of the socket body. The grounding ring has opposed arms extending outwardly through slots in the tubular socket wall. These arms terminate in annular lanced contact springs with a contact for grounding contact with a conductor of a printed circuit board.

The contacts and grounding ring are all inserted through the bulb end of the socket and snap fit into place. The grounding ring has dual contacts, one on each side for connection to ground on either side as desired. Using a grounding ring which may be connected to ground at either side, sockets can readily be interconnected. Since there are no crossovers, a printed circuit board can be used to connect to other sockets in a direct manner. With the bulb in place, the contacts are held firmly in place. Removal of the bulb allows access to the contacts for contact replacement, if necessary.

It is therefore an object of the invention to provide a bulb or lamp socket which allows the contacts and grounding ring to be inserted in the bulb end of the socket, the contacts and grounding ring being adapted to be locked in place by the bulb insertion.

It is a further object of the invention to provide a dual contact grounding ring which has a central tubular portion adapted to fit into the socket bulb cavity and engage the ferrule base of the bulb, and lanced contacts on opposite sides of the bulb for ready completion of the grounding path.

It is a still further object of the invention to provide a one-piece lamp socket in which the bulb contacts are identical and the grounding contact has a dual terminal outer segment so that the terminal segments of both the bulb contacts and the grounding rings are equally spaced about the bulb socket.

It is a still further object of the invention to provide a socket having a grounding ring with terminals at both sides for the connection of a grounding conductor to either side, or for serial connection to other grounding terminals.

DETAILED DESCRIPTION OF THE DRAWINGS

Figure 1:
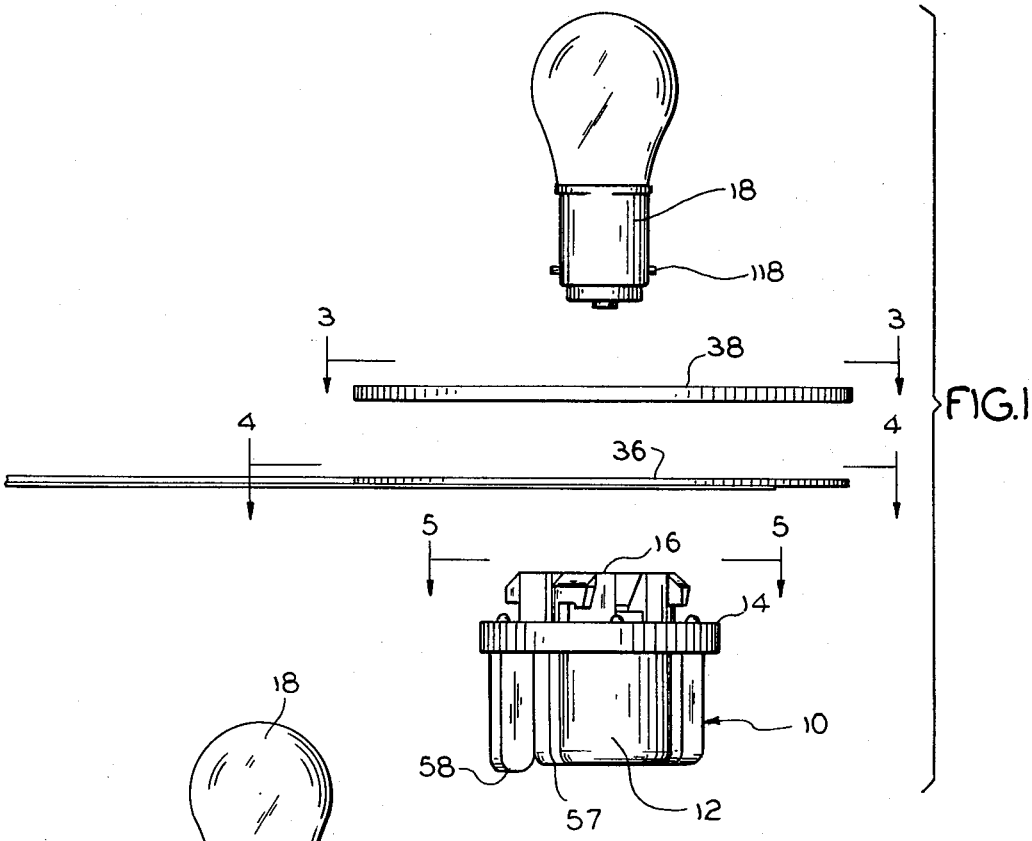
FIG. 1 is a side view in elevation of a socket, printed circuit (PC) board, mounting member and bulb shown in exploded form.

In FIG. 1, I show a generally cup-shaped, one-piece socket 10 with a generally closed base 12, forming a cavity for an upstanding bulb receiving tube 16, the tube having an annular outwardly spaced rim flange 14. The socket and tube may be fabricated as a unitary member of a suitable high temperature plastic such as that sold under the trade name NORYL. Preferably, the unitary socket will be molded. A standard, two-terminal bayonet bulb 18 is shown for insertion into the central socket opening 20 of the socket.

Figure 2:
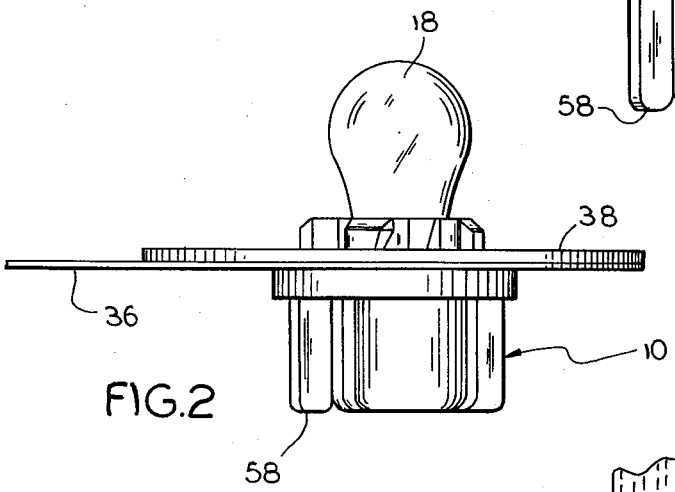
FIG. 2 is a side view in elevation of the element of FIG. 1 assembled.
Figure 3:
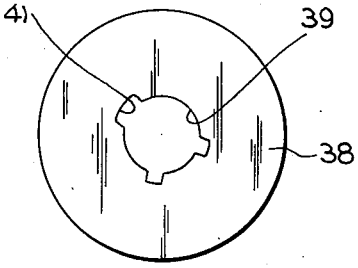
FIG. 3 is a plan view of the mounting member of FIG. 1.
Figure 4:
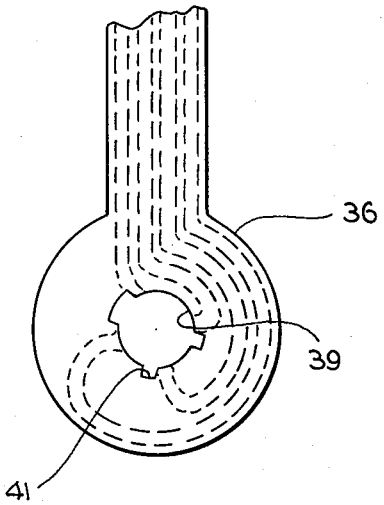
FIG. 4 is a plan view of the PC board of FIG. 1.
Figure 6:
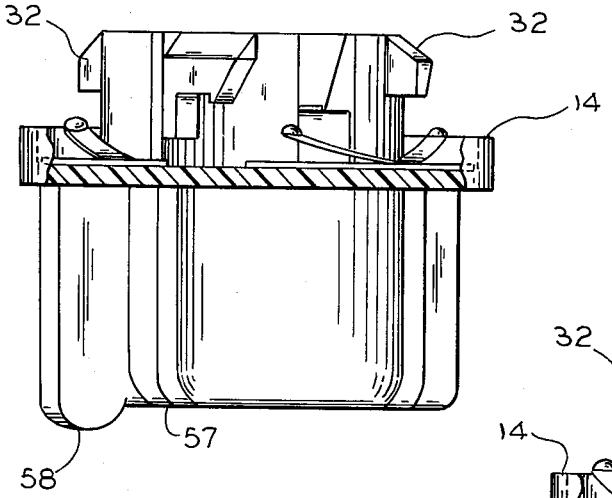
FIG. 6 is a side view in elevation of the socket of FIG. 1 as viewed from line 6—6 of FIG. 5 with the rim flange partially broken away.
Figure 7:
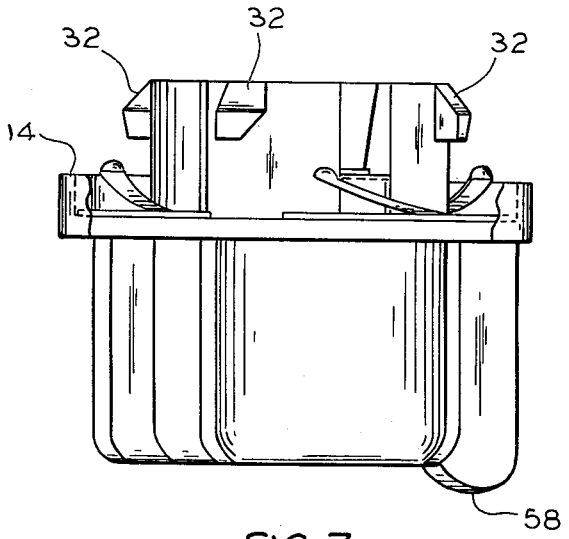
FIG. 7 is a side view in elevation of the socket as viewed from line 7—7 of FIG. 5.

The bulb receiving tube 16 has adjacent its top end a plurality of angularly spaced shoulders 32 extending radially outwardly of the wall 30 of tube 16. The shoulders are spaced in the height dimension a distance above the rim flange 14 sufficiently great to enable a printed circuit board 36 and mounting member 38 to be fitted between the flange and shoulders. Both the printed circuit board (shown in detail in FIG. 3) and the holder (shown in detail in FIG. 4) have a central bore 39 slightly larger than the outer periphery of tubular wall with insets 41 in the bore wall matching the shoulders of FIGS. 5–7 to enable the PC board 36 and holding member 38 to fit onto the socket and rest on the rim flange. By rotating the socket relative to the PC board and holder, the PC board and holder can be locked to the socket between flange 34 and shoulders 32 in the manner shown in FIG. 2. The holder member may also be a wall of a vehicle with suitable bore and shoulder-receiving inserts to enable the socket to be mounted to a vehicle wall.

Figure 5:
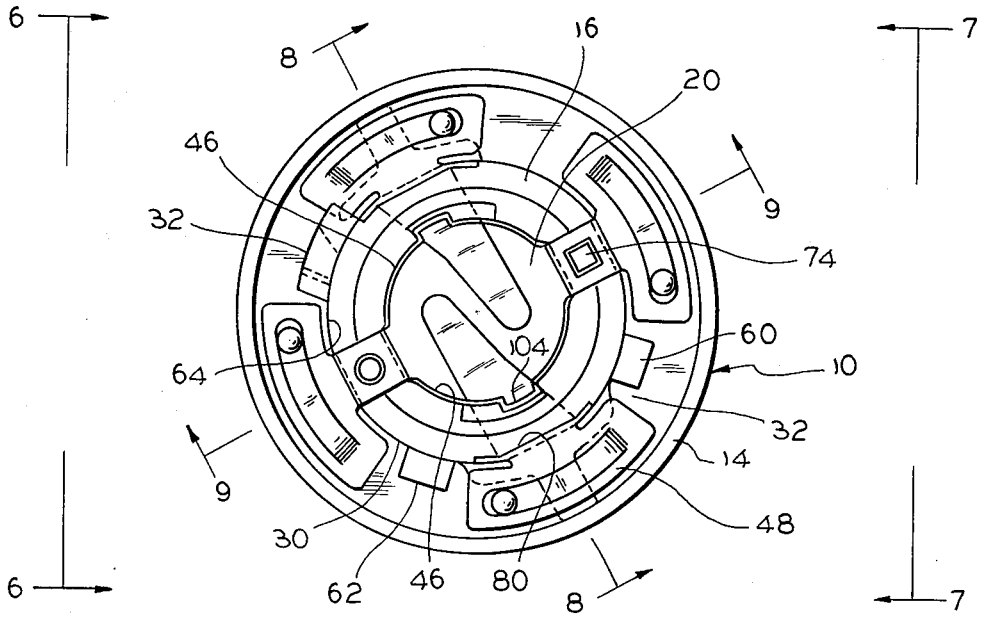
FIG. 5 is a plan view of the socket of FIG. 1.
Figure 8:
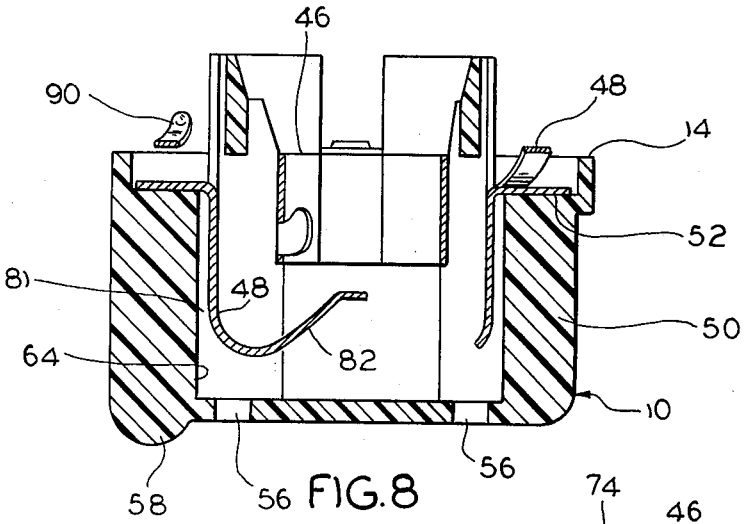
FIG. 8 is a sectional view taken along line 8—8 of FIG. 5.
Figure 9:
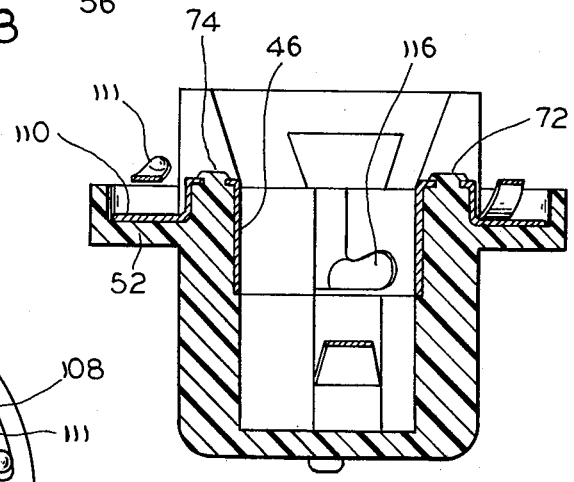
FIG. 9 is a sectional view taken along line 9—9 of FIG. 5.

In FIG. 5, I show an assembled but unmounted socket in plan view. In this view, there can be seen the socket (without bulb), the bulb receiving tube 16, the grounding ring 46 and two terminals 48. The socket, as mentioned and as can be seen in FIGS. 8 and 9, has a generally imperforate cup-shaped body 50 with an annulus 52 extending outwardly to provide a platform for retaining the grounding ring and contact terminals recessed below the rim flange 14, the rim flange forming a raised outer periphery of the annulus. On its opposed sides, the socket has a reinforced wall 57 below the annulus with mounting and reinforcing ribs 58.

Adjacent the ribs, the cup base has spaced slots 56 (see FIG. 8) extending into the socket bore as will be explained later. Further, the annulus 52 may have slots 60 and 62 extending through it adjacent the socket wall 64 as will be explained.

The bulb receiving tube 16 is sized to receive the grounding ring 46 and the bulb and has sufficient depth for the bulb contacts below the bulb. The entrance to the tube funnels inwardly to enable ready entry of a bulb. Incised into the top wall of the tube are two opposed slots 70 which terminate approximately adjacent to the top of rim flange. The bottom surface of one of these slots has an upwardly extending dowel rod 72 while the other has a square boss 74 extending upwardly for a short distance.

Approximately 90° angularly from the slot 62, the socket wall has recesses extending from above the annulus to essentially the base of the socket cavity. These recesses communicate with the base slots 56 to enable access of a tool such as a screwdriver into the socket cavity. Above the annulus, the recesses extend through the socket wall, the socket outer surface being flatted at flats 80 to produce a mounting chamber 81 for contact terminals 48.

Figure 12:
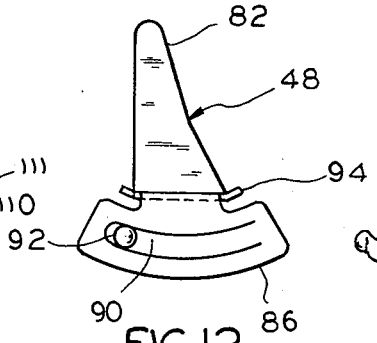
FIG. 12 is a plan view of a terminal contact of FIG. 5.
Figure 13:
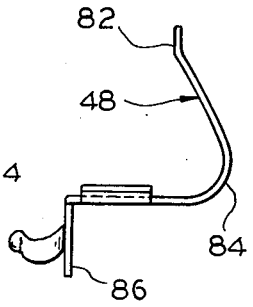
FIG. 13 is a side view in elevation of the terminal contact of FIG. 12.

A contact terminal 48, as seen best in FIGS. 12 and 13, is recurved in profile (FIG. 13) with a contact portion 82 forming an acute angle with the intermediate body portion 84 and has a terminal portion 86. The terminal portion 86 is formed at right angles to portion 84 and extends outwardly thereof, this portion being arcuate to follow the contour of the socket outer wall. A lanced terminal 90 with raised contact nib 92 at its end is cut from the terminal portion, the terminal 90 being stressed upwardly from the terminal portion to act as a spring contactor for engaging the conductor of a PC board. Side wings 94 on the intermediate portion angled inwardly are used to engage the socket wall, stabilize and hold the contact terminal firmly in the socket mounting chamber 81. Carbon steel may be used as the material for the terminal 48.

Two identical contact terminals 48 are used, each being assembled into the respective chamber. The bulb contacting end of each terminal extends into the cavity and is angled toward the bulb base to form a compression contact with the bulb tending to hold the contact more firmly in the socket. The terminal portion rests on the annulus 52 of the socket with the raised terminal extending above the level of the rim flange 34.

Figure 10:
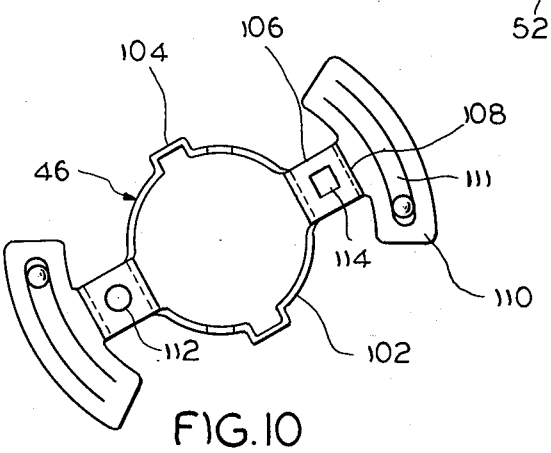
FIG. 10 is a plan view of the grounding ring of FIG. 5.
Figure 11:
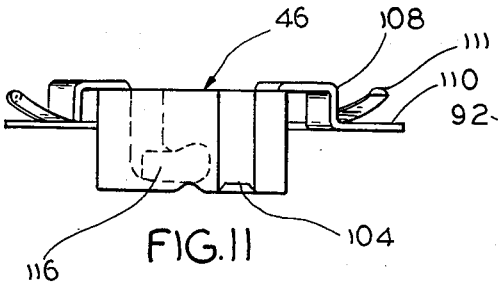
FIG. 11 is a side view in elevation of the grounding ring of FIG. 10.

The grounding ring contact 46 is shown in greatest detail in FIGS. 10 and 11. A central portion 102 of the ring contact is essentially tubular with squared bayonet receiving channels 104 opposite one another, each being spaced 90° from the terminal portion. From one axial end of the central portion 102 of the ring, lugs 106 protrude outwardly at a right angle from the central portion 102. The lugs are formed into downwardly directed spacer arms 108 parallel to the ring central portion 102 and leading to terminal portions 110. The terminal portions form arcuate segments parallel to the lugs 106 and spaced therefrom at a height about midway along the tube height. A terminal 111 is lanced from each respective terminal portions and is stressed at an acute angle from the respective terminal portion. Conductor contacting nibs 113 are raised in the tips of the terminals 111. Of the lugs, one has a circular opening 112 for receiving dowel 72 (during assembly), the other having a square opening 114 for receiving boss 74. By the use of different shapes in each side of the socket, the grounding ring can only be assembled in one mode. The tube wall of the grounding ring has a kidney-shaped opening 116 for receiving and mechanically locking a lamp bayonet prong 118 during assembly. The grounding ring may also be formed of suitable carbon steel to provide spring qualities for the terminal portion.

To assemble a socket structure, the socket is held with the bulb tube open upwardly. A contact terminal is inserted from the bulb end of the socket through the openings in the socket wall forming the chamber with its bulb contacting end extending into the bulb cavity. The wings contact the flatted wall of the socket to lock the terminal contact in place with its terminal portion extending in the annulus and its leaf spring contact stressed upwardly. The second contact terminal is inserted diametrically opposite the first in the same way.

The grounding ring is then positioned on the open end of the socket tube with the lugs fitted into the axially elongate slots 70 in the tube wall end such that the dowel rod opening 112 is aligned to fit on dowel rod 72 and the square opening is aligned to fit on the square boss 74. The grounding ring is then depressed to mate the openings on the dowel rod and boss and lock the grounding ring in place. The socket members 72 and 74 may then be staked or cold headed to lock the grounding ring to the socket. With the terminals and grounding ring in place, four angled terminal springs are spaced about annulus 52 each with contact tip extending above the rim flange.

The slots 56 in the base are aligned with the contact portion of the terminals and enable a tool to be inserted to push out the bulb opening for replacement with a bulb in place, the contacts cannot be detached nor can they fall out of the socket.

The bulb is inserted by placing the base in the socket bore with the bayonet prongs resting in the rectangular channels in the grounding ring. The bulb base is depressed against the cantilevered base contactor portion of the terminal. The base of the bulb is depressed until the bayonet prong can enter the shaped opening 116 for the bayonet prong, the opening being in communication with the one channel in the grounding ring. The bulb pressure holds the terminals and grounding ring firmly in place. Thereafter, the printed circuit board and mounting member may be fitted over the bulb globe, aligned with the shoulders and depressed onto the flange rim. The holding member is then twisted and locked in place between the rim and the shoulders.

Figure 14:
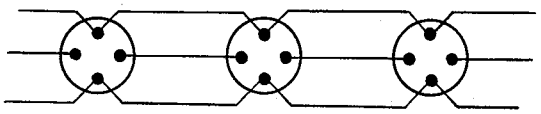
FIG. 14 is a schematic circuit drawing showing a number of sockets of the type shown herein connected together.

Either of the grounding ring terminals may be used or both may be employed as shown in the wiring diagram of FIG. 14 to complete a through ground path with a plurality of sockets in parallel.

I claim:

1. A lamp socket comprising a cup-shaped socket open at one end thereof, a tubular wall extending from said one end to form a cavity in said socket for receiving a bayonet-type bulb, an annular platform extending outwardly from said wall, said platform terminating in an upturned rim flange, a conductive ring within said cavity adjacent the wall thereof for conductive grounding contact with a bulb ferrule, said ring including spaced terminal portions arrayed in said annular platform, spaced openings in said tubular wall in communication with said platform for receiving respective bulb contacting members, each said last-mentioned member including an inwardly directed portion for compressively engaging a lamp contact, an intermediate contact member portion extending through the wall opening to a terminal portion in said platform, said terminal portions being spaced midway between the terminal portions of said ring, each said terminal portion including a spring contact or lanced therefrom angled above the rim flange equally spaced about said platform.

2. A lamp socket as claimed in claim 1, in which said socket has a closed base to enable insertion of the conductive ring and contacting members from the one end thereof.

3. A lamp socket as claimed in claim 1, in which there are spaced shoulders extending radially from said tubular wall spaced a distance from said rim flange to enable the capture therebetween of conductors for mating with the contactors.

4. A lamp socket as claimed in claim 1, in which there are axially elongate channels in said conducting ring for receiving radial bayonet prongs of a lamp bulb, and in which there is a slot in said ring in communication with one channel for locking one of said prongs.

5. A lamp socket adapted to receive a bayonet base bulb for use in an automotive vehicle, said socket comprising a lamp cavity defined by a tubular wall, a grounding ring mounted within said wall, said ring including a conductive tubular body for receiving a bulb, opposed channels extending in an axial direction along the tubular body for receiving bayonet prongs of a bulb, a locking slot in communication with one of said channels for locking the bulb therein with the body of the ring in conductive engagement with the bayonet prong of the bulb, said ring including terminal members directed radially from said grounding ring at diametrically opposed side positions of the ring body externally of said socket wall, said terminal members extending in a common plane and including lanced contactors stressed angularly from the terminal plane for completing grounding connections on both side positions of the socket.

6. A lamp socket as claimed in claim 5, in which said grounding ring is of one-piece metallic construction and further includes intermediate mounting members extending through said socket wall and engaging said socket wall in a locking relationship.

7. A lamp socket as claimed in claim 6, in which said socket wall includes slotted recesses therein for receiving said ring mounting members, and in which said terminal members are disposed in an annulus outside said tubular wall.

8. A lamp socket as claimed in claim 7, in which there are bulb contacting members extending through said tubular wall and having a bulb contacting portion stressed to compressive contact with a bulb in said cavity, said bulb contacting members having terminal portions extending in the plane of the grounding ring terminal portions within said annulus and each of said last-mentioned terminal having a stressed contactor angled from the plane.

* * * * *